US008528187B2

(12) United States Patent
Wang et al.

(10) Patent No.: US 8,528,187 B2
(45) Date of Patent: Sep. 10, 2013

(54) METHOD AND APPARATUS FOR JOINING MULTIPLE COMPONENTS

(75) Inventors: Pei-Chung Wang, Shanghai (CN); David Yang, Pudong (CN); Jeff Wang, Jiangsu (CN); Blair E. Carlson, Ann Arbor, MI (US)

(73) Assignee: GM Global Technology Operation LLC, Detroit, MI (US)

( * ) Notice: Subject to any disclaimer, the term of this patent is extended or adjusted under 35 U.S.C. 154(b) by 238 days.

(21) Appl. No.: 13/162,625

(22) Filed: Jun. 17, 2011

(65) Prior Publication Data

US 2012/0317786 A1 Dec. 20, 2012

(51) Int. Cl.

| | |
|---|---|
| ***B21D 39/00*** | (2006.01) |
| ***B21D 31/00*** | (2006.01) |
| ***B21D 13/00*** | (2006.01) |
| ***B21K 25/00*** | (2006.01) |

(52) U.S. Cl.
USPC ..... 29/521; 29/505; 29/515; 29/283.5; 72/363; 72/379.2

(58) Field of Classification Search
USPC ..... 29/505, 510, 515, 521, 522.1, 525, 29/283.5; 72/363, 379.2, 379.6, 377
See application file for complete search history.

(56) References Cited

U.S. PATENT DOCUMENTS

| | | | | |
|---|---|---|---|---|
| 4,129,026 | A * | 12/1978 | Pierce et al. | 72/370.13 |
| 4,760,634 | A * | 8/1988 | Rapp | 29/509 |
| 4,831,711 | A * | 5/1989 | Rapp | 29/509 |
| 4,897,912 | A * | 2/1990 | Slasinski | 29/432.2 |
| 6,625,887 | B1 * | 9/2003 | Kanemitsu et al. | 29/892.3 |
| 6,684,479 | B2 * | 2/2004 | Wang et al. | 29/521 |
| 7,003,861 | B2 * | 2/2006 | Sawdon et al. | 29/432 |
| 8,024,848 | B2 * | 9/2011 | Carter | 29/432 |

* cited by examiner

*Primary Examiner* — Alexander P Taousakis
*Assistant Examiner* — Jun Yoo
(74) *Attorney, Agent, or Firm* — Quinn Law Group, PLLC

(57) ABSTRACT

A method of joining multiple components includes stacking the components vertically. Each component includes two opposite substantially planar surfaces that are arranged in a column when the components are stacked. The method also includes placing the stacked components in a clinch-crimping apparatus having a first punch, a second punch, and a crimping element. The method also includes displacing a section of the substantially planar surfaces of the stacked components by driving the first punch in a first direction that is substantially perpendicular to the surfaces. The method additionally includes retracting the first punch from the displaced section and crimping the displaced section by the crimping element to form a crush initiator. The method additionally includes disengaging the crimping element from the crimped, displaced section. Furthermore, the method includes clinching the crimped, displaced section by driving the second punch in a second direction that is opposite to the first direction.

10 Claims, 4 Drawing Sheets

FIG. 7
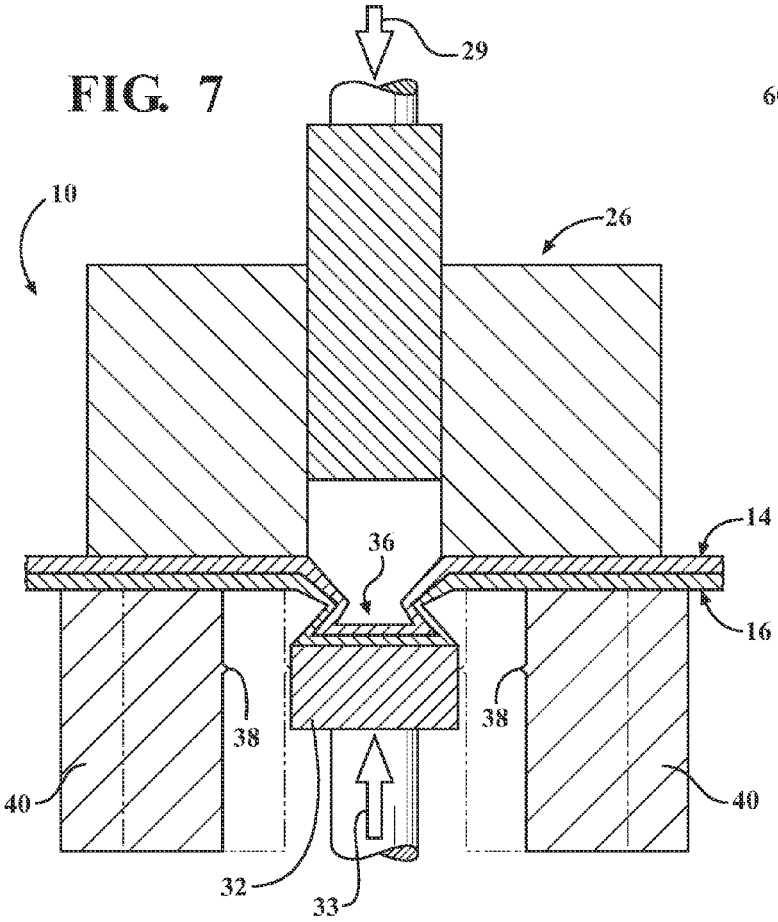
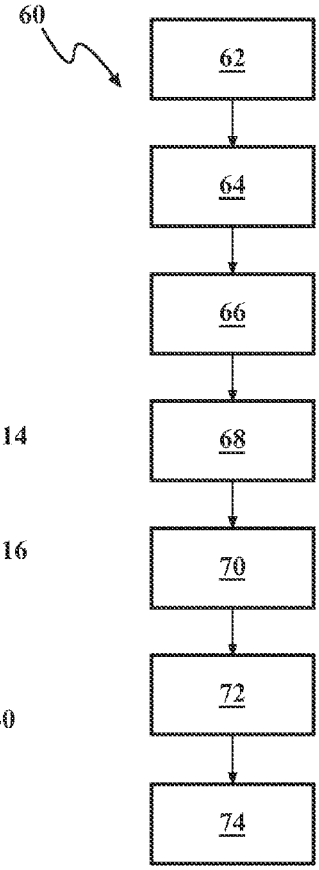
FIG. 9
FIG. 8
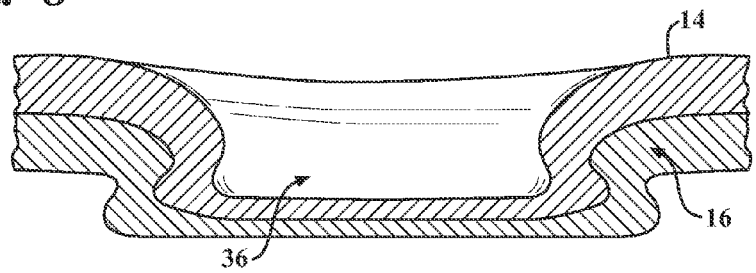

METHOD AND APPARATUS FOR JOINING MULTIPLE COMPONENTS

TECHNICAL FIELD

The invention relates to a method and an apparatus for joining multiple components.

BACKGROUND

Various processes and mechanisms are available in manufacturing for linking or joining various components. A specific joining process and/or mechanism is typically selected based on the materials of the components sought to be joined and the operating conditions that the structure formed from the joined components will be asked to endure. Additionally, a specific joining process and/or mechanism may be selected based on whether the subject components are sought to be joined permanently or are required to be separable.

Vehicle structures are commonly formed from different types and grades of various materials such as steel, aluminum, magnesium, and plastic. Frequently, additional reinforcing members are used to buttress the vehicle structure, as well as for supporting various chassis and powertrain subsystems. Joining processes for forming vehicle structures and additional reinforcing/supporting members are typically selected with consideration given to at least some of the factors noted above. Common joining processes for vehicle structures include the use of welding, gluing, and various mechanical fasteners.

SUMMARY

A method of joining multiple components includes stacking the components vertically. Each component includes two opposite substantially planar surfaces that are arranged in a column when the components are stacked. The method also includes placing the stacked components in a clinch-crimping apparatus having a first punch, a second punch, and a crimping element. The method also includes displacing or upsetting a section of the substantially planar surfaces of the stacked components by driving the first punch in a first direction that is substantially perpendicular to the substantially planar surfaces. The method additionally includes retracting or pulling the first punch away from the displaced section and crimping the displaced section by the crimping element to form a crush initiator. The method additionally includes disengaging the crimping element from the crimped, displaced section. Furthermore, the method includes clinching, collapsing, or crushing the crimped, displaced section by driving the second punch in a second direction that is opposite to the first direction.

The clinch-crimping apparatus may include an upper die configured to house the first punch and a lower die configured to house the second punch and the crimping element. In such a case, the upper die may be configured to apply a force to hold the stacked components between the first and second dies.

The method may also include controlling the force applied by the upper die such that the first punch displaces the section of the substantially planar surfaces of the stacked components for a desired distance without failure of the section.

The crimping element may also include a plurality of teeth, such that the crimping of the displaced section of the substantially planar surfaces may include using the plurality of teeth.

The lower die may include a plurality of movable sections and each of the plurality of movable sections may include at least one of the plurality of teeth. In such a case, the crimping of the displaced section and the disengaging of the crimping element may include respectively engaging with and disengaging from the displaced section the plurality of movable sections.

The lower die may include an actuating mechanism. In such a case, the method may include selectively engaging and disengaging the plurality of teeth using the actuating mechanism.

The first punch may include a plurality of grooves. In such a case, the method may additionally include clearing the crimped, displaced section of the substantially planar surfaces of the stacked components using the grooves when the first punch is retracted.

The method may additionally include driving the first and the second punches using a servomotor.

The method may additionally include locally heating the section of the substantially planar surfaces of the stacked components to increase the formability of the stacked components.

The stacked components may be sheets of at least one of steel, aluminum, and magnesium.

A clinch-crimping apparatus configured to perform the above method is also disclosed.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 7 is a schematic illustration of a cross-section of the clinch-crimping apparatus shown in FIG. 1, with the apparatus being shown during the clinching stage of the joining process;

FIG. 8 illustrates a cross-section of the displaced section after the stacked components have been clinch-crimped by the clinch-crimping apparatus; and FIG. 9 is a flow chart illustrating a method of joining multiple components via the clinch-crimping apparatus.

DETAILED DESCRIPTION

Figure 2:
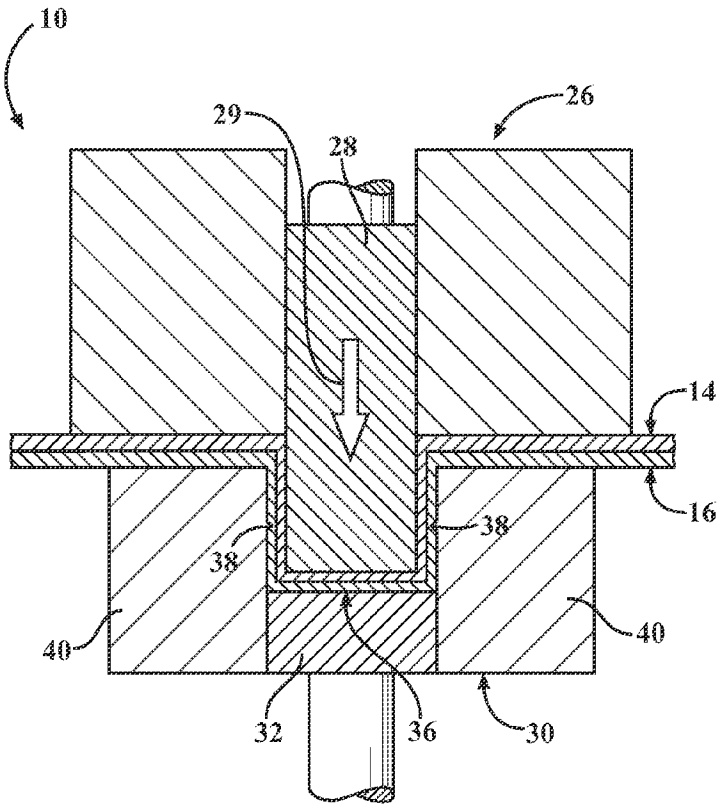
FIG. 2 is a schematic illustration of a cross-section of the clinch-crimping apparatus shown in FIG. 1, with the apparatus being shown as the first punch displaces the section of the stacked components.

Referring to the drawings in which like elements are identified with identical numerals throughout, FIGS. 1-7 illustrate a clinch-crimping apparatus 10 for joining components 14 and 16, which are shown as two vertically stacked sheets of material. The components 14 and 16 may each be formed from a malleable material such as steel, aluminum, magnesium, or a polymer compound. Additionally, the material of the component 14 may be dissimilar from the material of the component 16 and still be reliably joined by the clinch-crimping apparatus 10.

Although components 14 and 16 are shown as two sheets of material, each of the components may also have a largely variable shape that additionally includes two opposite, substantially planar surfaces. In particular, the component 14 includes substantially planar surfaces 18 and 20, while the component 16 includes substantially planar surfaces 22 and 24. When such components 14 and 16 having largely variable shapes are stacked vertically, the substantially planar surfaces 18, 20, 22, and 24 are arranged in a column prior to being joined, such that the planar surfaces 18, 20 are disposed directly below the planar surfaces 22, 24. Accordingly, the clinch-crimping apparatus 10 may join the components 14, 16 at the substantially planar surfaces 18, 20, 22, and 24 to ensure a robust assembly.

Figure 1:
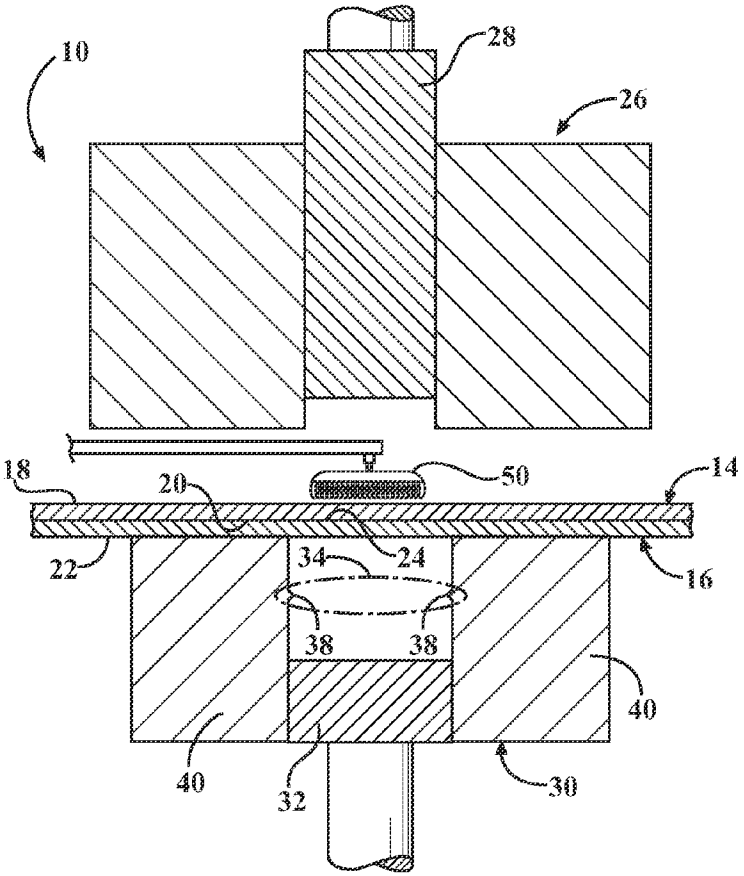
FIG. 1 is a schematic illustration of a cross-section of a clinch-crimping apparatus when stacked components are being loaded in to the apparatus for being joined, with the apparatus including a heating element for locally heating a section of the stacked components.

As shown in FIG. 1, the clinch-crimping apparatus 10 includes an upper die 26 having a first punch 28, and a lower die 30 having a second punch 32 and a crimping element 34. In order to be joined by the clinch-crimping apparatus 10, the stacked components 14 and 16 are placed between the upper die 26 and the lower die 30. The upper die 26 is configured to apply a force to the stacked components 14, 16 and against the lower die 30, in order to hold the stacked components in the clinch-crimping apparatus 10.

The first punch 28 is configured to be driven in a first direction 29 (as shown in FIG. 2) that is substantially perpendicular to the substantially planar surfaces 18, 20, 22, and 24 of the stacked components 14, 16. Such actuation of the first punch 28 is configured to form a displaced section 36 of the substantially planar surfaces 18, 20, 22, and 24. The first punch 28 is also configured to retract into the upper die 26 following the desired forming of the displaced section 36.

The force applied by the upper die 26 may be varied, such that the first punch 28 displaces the material of the stacked components 14, 16 for a desired distance, in order to form the displaced section 36 without failure of the section. Variably controlling the force applied by the upper die 26 permits the first punch 28 to travel deeper into the lower die 30 as additional material of the stacked components 14, 16 is carried into the lower die 30. Such variable force capability may be especially useful in forming the displaced section 36 from materials having tensile strength that is lower as compared to steel, for example magnesium.

The crimping element 34 is configured to crimp the displaced section 36 of the stacked components 14, 16 to form a crush initiator on the surface of the displaced section. In general, a crush initiator is a preliminary deformation generated on a surface of a structure, such that in the event of anticipated loading the structure will commence to collapse at the deformation in a predictable manner. As shown in FIGS. 1-7, the crimping element 34 includes a plurality of teeth 38 that are configured to dimple the displaced section 36, thus forming the crush initiator. The teeth 38 are movable generally in parallel relative to the surfaces 18, 20, 22, and 24 of the stacked components 14, 16 in order to dimple the surface of the displaced section 36 and then be retracted. The teeth 38 may be movable by a variety of mechanisms in order to crimp the surface of the displaced section 36.

Figure 4:
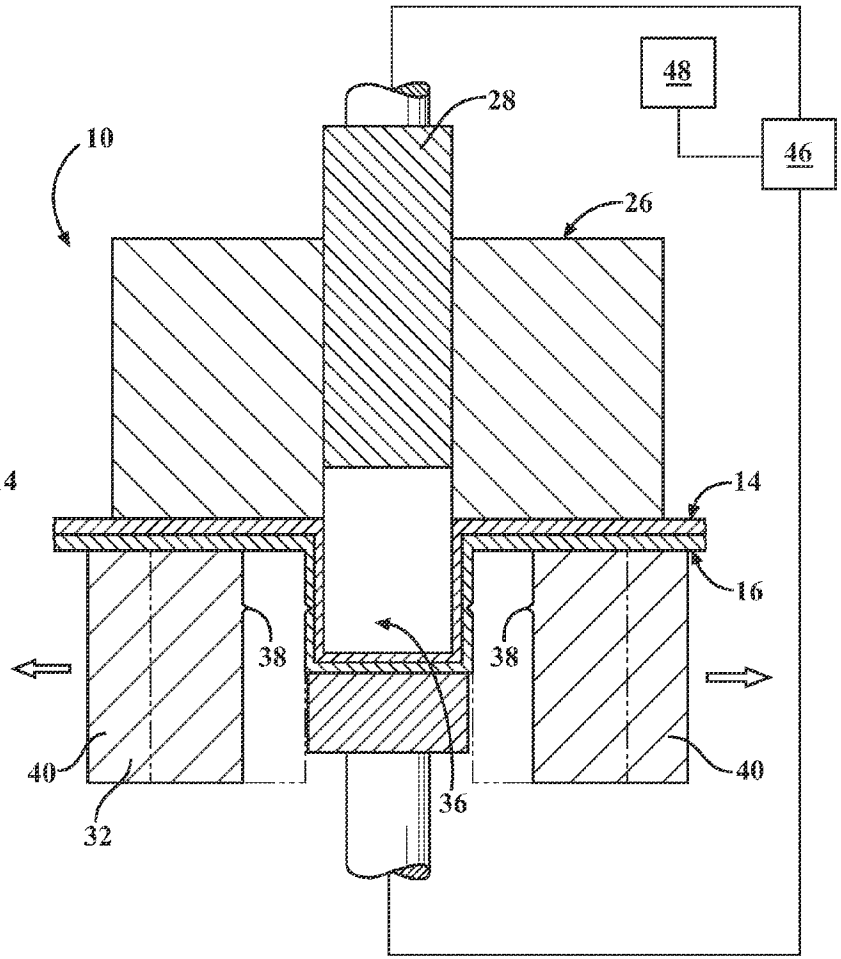
FIG. 4 is a schematic illustration of a cross-section of the clinch-crimping apparatus shown in FIG. 1, with the apparatus being shown as the plurality of movable lower die sections is retracted following the crimping stage of the joining process.
Figure 3:
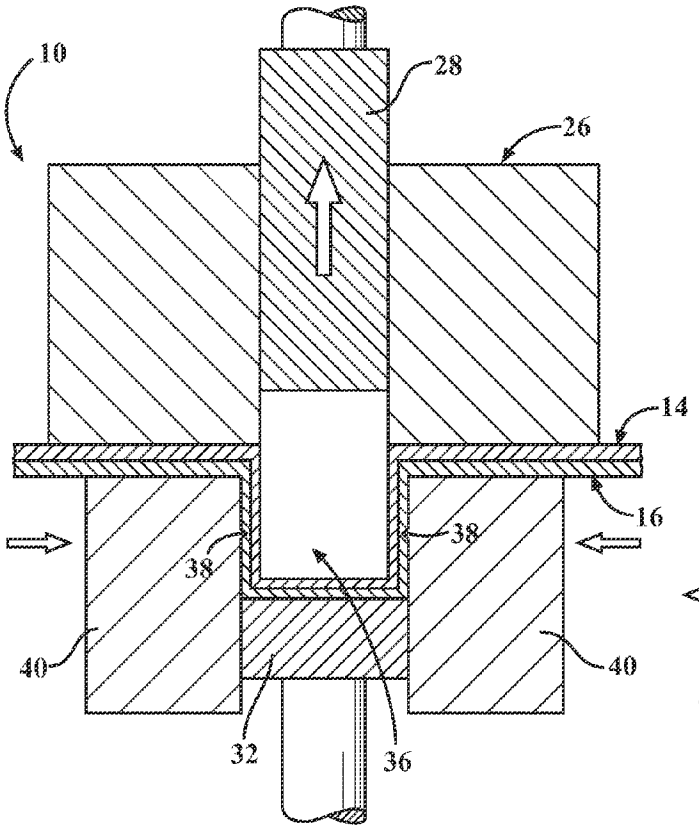
FIG. 3 is a schematic illustration of a cross-section of the clinch-crimping apparatus shown in FIG. 1, with the apparatus being shown employing a plurality of movable lower die sections during the crimping stage of the joining process as the first punch being retracted.
Figure 6:
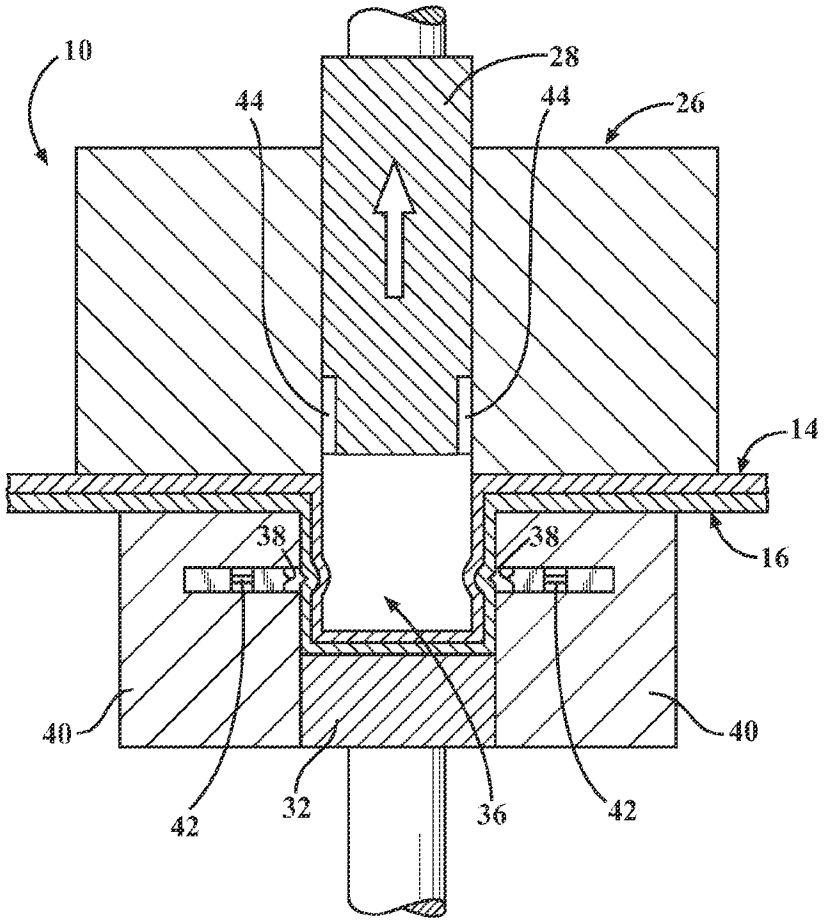
FIG. 6 schematic illustration of a cross-section of the clinch-crimping apparatus shown in FIG. 5, with the apparatus being shown as the teeth actuating mechanism is being retracted following the crimping stage of the joining process.
Figure 5:
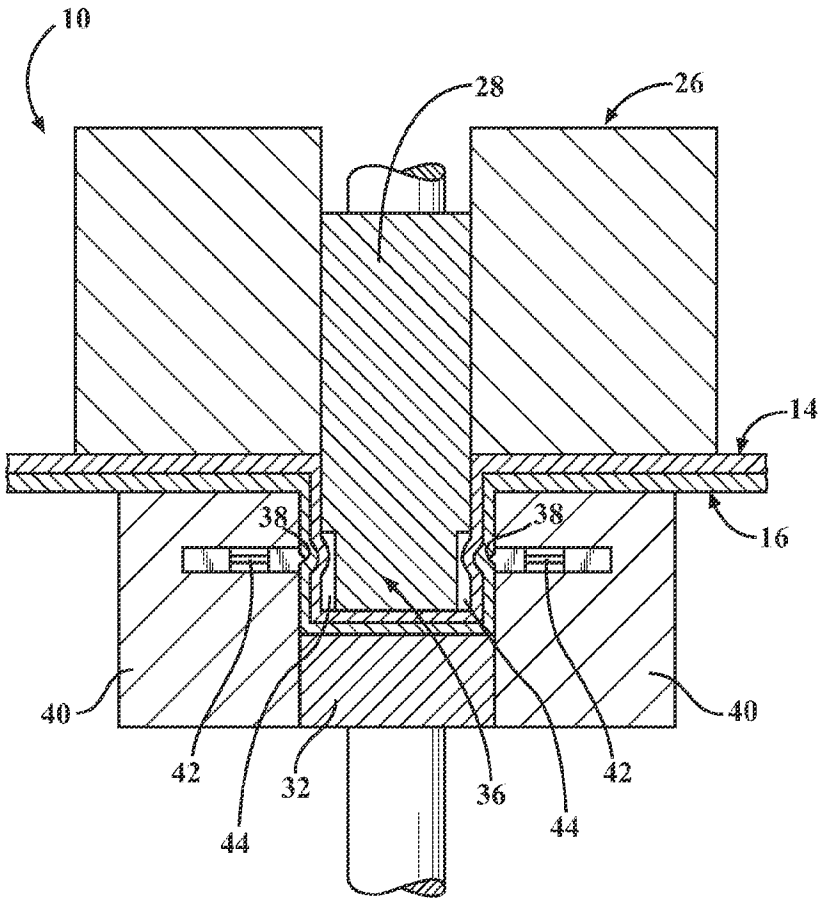
FIG. 5 is a schematic illustration of a cross-section of the clinch-crimping apparatus, with the apparatus being shown employing a first punch having a plurality of grooves configured to clear a plurality of crimping teeth and a teeth actuating mechanism during the crimping stage of the joining process.

As shown in FIGS. 4 and 7, the lower die 30 may include a plurality of movable lower sections 40 for moving the teeth 38 to crimp the displaced section 36. In such a case, at least one of the plurality of teeth 38 is operatively connected to each one of the plurality of sections 40, wherein each one of the plurality of sections is configured to be selectively engaged with and disengage from the displaced section 36. As an alternative example, the lower die 30 may include an actuating mechanism 42 configured to selectively engage the plurality of teeth 38 with and disengage the plurality of teeth from the displaced section 36, as shown in FIGS. 5-6. The actuating mechanism 42 may be configured as a mechanical, electromechanical, or a hydraulic device.

Additionally, as shown in FIGS. 5-6, the first punch 28 may include a plurality of grooves 44 configured to clear the teeth 38 during the crimping stage of the clinch-crimping process. Furthermore, the plurality of grooves 44 serves to clear the previously crimped, displaced section 36 of the stacked components 14, 16 when the first punch 28 is retracted. Accordingly, the crimped, displaced section 36 is permitted to pass through the grooves 44, thus allowing the first punch 28 to disengage the crimped, displaced section and withdraw into the upper die 26.

As shown in FIG. 7, the second punch 32 is configured to clinch the previously crimped, displaced section 36 of the stacked components 14, 16 by being driven in a second direction 33 that is opposite to the first direction 29. The clinching of the displaced section 36 crushes or collapses the displaced section along the crush initiator generated by the teeth 38 on the surface of the displaced section. The collapsed portion of the displaced section 36 forms a mushroom shape that effectively rivets the material of the stacked components 14, 16 onto itself.

As shown in FIG. 4, the clinch-crimping apparatus 10 may include a servomotor 46 configured to drive each of the first and the second punches 28, 32 in order to accomplish the clinch-crimping of the stacked components 14, 16 according to the above description. The servomotor 46 may be regulated by a controller 48 which is programmed with an algorithm for performing the subject clinch-crimping operation.

The clinch-crimping apparatus 10 may also include a device 50, such as one or more strategically placed induction coils, that is configured to locally heat or anneal the substantially planar surfaces 18, 20, 22, 24 of the stacked components 14, 16 to increase the formability of the stacked components. The contemplated local heating may also be accomplished via a stream of fluid or air characterized by a temperature that is sufficiently elevated to anneal the substantially planar surfaces 18, 20, 22, 24 to improve the subject material's ductility. The device 50 may be brought in to locally heat the substantially planar surfaces 18, 20, 22, 24 via a specifically configured robot or an end-of-arm tooling (not shown). Such local heating of the section 36 may be particularly beneficial for clinch-crimping materials such as magnesium. The local heating of the substantially planar surfaces 18, 20, 22, 24 is intended to be performed prior to but close in time to when those surfaces are to be displaced by the first punch 28.

FIG. 8 illustrates a cross-section of the displaced section 36 after the components 14 and 16 have been clinch-crimped by the clinch-crimping apparatus 10.

FIG. 9 depicts a method 60 of joining multiple components. The method 60 is described herein with respect to joining the components 14 and 16 in the clinch-crimping apparatus 10 shown in FIGS. 1-7. Method 60 is equally applicable to having the stacked components 14 and 16 passed through a stationary clinch-crimping apparatus 10, such as by a conveyor, as well as having the clinch-crimping apparatus being traversed over stationary stacked components, to generate multiple clinch-crimped joints on the components.

The method commences in frame 62 with stacking the components 14 and 16 vertically, wherein each component the substantially planar surfaces 18, 20, 22, and 24 are arranged in a column. After frame 62, the method proceeds to frame 64 with placing the stacked components 14 and 16 in the clinch-crimping apparatus 10. Following frame 64, the method advances to frame 66, where it includes displacing the section 36 of the substantially planar surfaces 18, 20, 22, 24 by driving the first punch 28 in the first direction 29. From frame 66, the method proceeds to frame 68, where the method includes retracting the first punch 28 from the displaced section 36.

After the first punch 28 has been retracted from the displaced section 36, the method advances to frame 70 where it includes crimping the displaced section 36 by the crimping element 34 to form a crush initiator on the surface of the displaced section. Following frame 70, the method progresses to frame 72, where it includes disengaging the crimping element 34 from the crimped, displaced section 36. The method concludes in frame 74, where it includes clinching the crimped, displaced section 36 by driving the second punch 32 in the second direction 33.

While the best modes for carrying out the invention have been described in detail, those familiar with the art to which this invention relates will recognize various alternative designs and embodiments for practicing the invention within the scope of the appended claims.

The invention claimed is:

1. A method of joining multiple components, the method comprising:

stacking the components vertically, wherein each component includes two opposite substantially planar surfaces and the substantially planar surfaces of the stacked components are arranged in a column;

placing the stacked components in a clinch-crimping apparatus having a first punch, a second punch, and a crimping element;

displacing a section of the substantially planar surfaces of the stacked components by driving the first punch in a first direction that is substantially perpendicular to the substantially planar surfaces;

retracting the first punch from the displaced section of the substantially planar surfaces of the stacked components;

crimping the displaced section of the substantially planar surfaces of the stacked components using the crimping element to form a crush initiator;

disengaging the crimping element from the crimped, displaced section of the substantially planar surfaces of the stacked components; and clinching the crimped, displaced section of the substantially planar surfaces of the stacked components by driving the second punch in a second direction that is opposite to the first direction.

2. The method of claim 1, wherein the clinch-crimping apparatus includes an upper die configured to house the first punch and a lower die configured to house the second punch and the crimping element, and wherein the upper die is configured to apply a force to hold the stacked components between the first and second dies.

3. The method of claim 2, further comprising controlling the force applied by the upper die such that the first punch displaces the section of the substantially planar surfaces of the stacked components for a desired distance without failure of the section.

4. The method of claim 1, wherein the crimping element includes a plurality of teeth, and wherein said crimping of the displaced section of the substantially planar surfaces includes using the plurality of teeth.

5. The method of claim 4, wherein the lower die includes a plurality of movable sections and each of the plurality of movable sections includes at least one of the plurality of teeth, and wherein said crimping the displaced section and said disengaging the crimping element includes respectively engaging with and disengaging from the displaced section the plurality of movable sections.

6. The method of claim 4, wherein the lower die includes an actuating mechanism, the method further comprising:

selectively engaging and disengaging the plurality of teeth using the actuating mechanism.

7. The method of claim 1, wherein the first punch includes a plurality of grooves, further comprising:

clearing the crimped, displaced section of the substantially planar surfaces of the stacked components using the grooves when the first punch is retracted.

8. The method of claim 1, further comprising driving the first and the second punches using a servomotor.

9. The method of claim 1, further comprising locally heating the section of the substantially planar surfaces of the stacked components to increase the formability of the stacked components.

10. The method of claim 1, wherein the stacked components are sheets of at least one of steel, aluminum, and magnesium.

* * * * *